US008702188B2

(12) United States Patent
Kida

(10) Patent No.: US 8,702,188 B2
(45) Date of Patent: Apr. 22, 2014

(54) DEVICE AND METHOD FOR DRIVING LIQUID-DROP EJECTION HEAD AND IMAGE FORMING APPARATUS

(75) Inventor: Hitoshi Kida, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 843 days.

(21) Appl. No.: 12/591,088

(22) Filed: Nov. 6, 2009

(65) Prior Publication Data

US 2010/0123909 A1 May 20, 2010

(30) Foreign Application Priority Data

Nov. 17, 2008 (JP) ..... 2008-293784

(51) Int. Cl.
*B41J 29/38* (2006.01)

(52) U.S. Cl.
USPC ..... 347/9; 347/5

(58) Field of Classification Search
USPC ..... 347/9
See application file for complete search history.

(56) References Cited

U.S. PATENT DOCUMENTS

| | | | | |
|---|---|---|---|---|
| 5,285,215 | A | 2/1994 | Liker | |
| 6,488,349 | B1 | 12/2002 | Matsuo et al. | |
| 2002/0018085 | A1* | 2/2002 | Asauchi et al. | 347/10 |
| 2006/0071980 | A1 | 4/2006 | Usui | |

FOREIGN PATENT DOCUMENTS

| | | | |
|---|---|---|---|
| JP | 2000-103090 | | 4/2000 |
| JP | 2001146011 | A | 5/2001 |
| JP | 2001-315324 | | 11/2001 |
| JP | 3264422 | | 12/2001 |
| JP | 3419372 | | 4/2003 |
| JP | 2004-058428 | | 2/2004 |
| JP | 2006095765 | A | 4/2006 |
| JP | 2006-247840 | | 9/2006 |
| JP | 2007062326 | A | 3/2007 |
| JP | 2008062548 | A | 3/2008 |
| JP | 2008-093950 | | 4/2008 |

OTHER PUBLICATIONS

Abstract of JP 10-081012 published on Mar. 31, 1998.
Abstract of JP 2000-280475 Published on Oct. 10, 2000.
Japanese Office Action dated Feb. 19, 2013 for corresponding Japanese Application No. 2008-293784.

* cited by examiner

*Primary Examiner* — Uyen Chau N Le
*Assistant Examiner* — Kajli Prince
(74) *Attorney, Agent, or Firm* — Harness, Dickey & Pierce

(57) ABSTRACT

An OFF timing of a drive waveform is set to be concentrated on a position of the drive waveform where a long time with substantially no voltage fluctuation can be ensured, and a pulse present before the position timewise is sequentially selected and applied to a pressure generating element.

21 Claims, 10 Drawing Sheets

DEVICE AND METHOD FOR DRIVING LIQUID-DROP EJECTION HEAD AND IMAGE FORMING APPARATUS

CROSS-REFERENCE TO RELATED APPLICATIONS

The present application claims priority to and incorporates by reference the entire contents of Japanese Patent Application No. 2008-293784 filed in Japan on Nov. 17, 2008.

BACKGROUND OF THE INVENTION

1. Field of the Invention

The present invention relates to a technology for driving a liquid-drop ejection head that ejects liquid drops of ink or the like.

2. Description of the Related Art

In an image forming apparatus using an inkjet head, at the time of forming an image on a recording medium, images and characters are created by dots formed by liquid drops ejected from the inkjet head, which have landed on the recording medium. Generally, each dot is formed only on a grid of a predetermined size.

In this type of image forming apparatus, when an image is formed with a resolution of, for example, 600 dpi×600 dpi (600 dots×600 dots with respect to a space of 1 inch square), four types of dots of different sizes are used to record one pixel with 5 gray scales including no dot formation by using four types of dots of different sizes. Accordingly, an image of the same level as an image formed with a resolution of about 1200 dpi×1200 dpi can be expressed with 2 gray scales of forming dots or not forming dots with respect to one pixel by using only dots of the same size, although it is with a resolution of 600 dpi×600 dpi. Further, because the image is formed with a resolution of 600 dpi×600 dpi, the image can be formed with a time shorter than that of the case of forming an image with a resolution of about 1200 dpi×1200 dpi.

As a method of forming dots of different sizes, gray scale recording by multipulse printing has been widely used. According to this method, the number of pulses to be applied to a pressure generating element in one printing cycle is varied or a pulse with a different ejection amount of a liquid drop is selected and applied to the pressure generating element, to vary the ejection amount of the liquid drop for each printing cycle, and when a plurality of pulses are applied to the pressure generating element, a plurality of ejected liquid drops are combined in the air to land on the recording medium or all the ejected liquid drops land close to each other without combining these in the air, thereby forming dots for one pixel (for example, see U.S. Pat. No. 5,285,215 and Japanese Patent No. 3264422).

Further, for example, in Japanese Patent No. 3419372, there is disclosed a driving method of an inkjet head in which a drive waveform of a plurality of pulses is formed by pulses with different ejection amounts by a varying voltage or a shape such as a pulse width for each pulse, and one pulse or a plurality of pulses is selected among these pulses and applied to a pressure generating element, thereby ejecting liquid drops with different ejection amounts for each printing cycle.

In the driving method, such a design is possible by a drive voltage and the pulse width that a rate of a liquid drop to be ejected next becomes faster than that of a liquid drop previously ejected to combine these ejected liquid drops in the air or to land these liquid drops close to each other. Therefore, an interval between pulses can be designed to be wide, and the drive waveform can be turned off at a long time after an electric current of the drive waveform approximately stops, even between the pulses. Recently, however, along with the speeding up of recording, one printing cycle has become shorter, and it is required to narrow the interval between pulses.

Furthermore, when it is attempted to eject large liquid drops as much as possible with a limited voltage applicable to a pressure generating element, or for simplifying a waveform generating unit to realize cost reductions, there has been a demand to eject liquid drops with different sizes for each printing cycle from the same nozzle by forming each pulse in a voltage waveform of the same shape and varying the number of pulses to be applied to the pressure generating element.

As a method of applying a plurality of pulses of a same shape, for example, Japanese Patent Application Laid-open No. 2001-315324 discloses a driving method of an inkjet head in which ON/OFF control signals having a 5-pulse drive waveform in one printing cycle and set to increase the number of pulses to be selected in order from a center pulse are prepared in six types, as shown in FIG. 2, from one selecting 0 pulses to the one selecting five pulses, so that liquid drops of 0 nanograms, 10 nanograms, 20 nanograms, 30 nanograms, 40 nanograms, and 50 nanograms can be ejected, and four types among these types are selected to perform gray scale recording.

However, in the invention described in Japanese Patent Application Laid-open No. 2001-315324, it is not taken into consideration to combine ejected liquid drops in the air, and it is difficult to have all the ejected liquid drops landed close to each other, unless relative movement speed of the inkjet head and the recording medium is low. To make the rate of liquid drops to be ejected next faster than that of a liquid drop previously ejected to combine these ejected liquid drops in the air or to have all the ejected liquid drops landed close to each other even if the relative movement speed of the inkjet head and the recording medium is fast, residual vibration due to previous ejection is used as described later in the pulses of the same shape. Accordingly, the interval between the pulses needs to be made narrow.

An electric circuit of an inkjet head includes a resistance component, a capacitor component, and a coil component, and a transmission line of a drive waveform also forms a resistor-capacitor (RC) circuit. Therefore, as shown in FIG. 3, there is a delay in the waveform of a drive current with respect to that of the drive voltage. A piezoelectric element frequently used as a pressure generating element of an inkjet head has a structure such that a ferroelectric substance is positioned between electrodes, and this tendency is noticeable because of characteristics of a capacitor.

A case of using a piezoelectric element as a pressure generating element is explained next. At a point in time shown in FIG. 4 when a drive waveform is turned off, charging of the piezoelectric element is substantially completed, and a sufficient displacement amount of the piezoelectric element has been obtained. Therefore, even if the drive waveform is turned off at this timing, ejection is hardly affected. However, if the drive waveform is turned off simultaneously with respect to many piezoelectric elements at a point in time in FIG. 4 when the drive waveform is turned off, a position where a charging current is still flowing in a considerable amount is abruptly stopped. Therefore, as shown in FIG. 4, a noise is generated in the waveform of the drive voltage due to an influence of the coil component in the transmission line of the drive waveform.

According to this principle, when an interval between pulses is made narrow due to the reasons described above, if the drive waveform is turned off between the pulses as in the conventional manner at the time of selecting some pulses from a plurality of pulses and applying these pulses to a pressure generating element by ON/OFF control of the drive waveform, a noise can be generated in the drive waveform because the current is still flowing in the transmission line of the drive waveform at an OFF timing due to the narrow interval. When the noise is generated in the drive waveform, the noise is not applied to a nozzle already turned off. However, the noise is directly applied to a nozzle being turned on at the time of noise generation, to affect ejection or cause a malfunction of an apparatus due to radiation noise.

SUMMARY OF THE INVENTION

It is an object of the present invention to at least partially solve the problems in the conventional technology.

According to one aspect of the present invention, there is provided a device for driving a liquid-drop ejection head that includes a plurality of nozzles each ejecting liquid, a pressure generating element that generates pressure for ejecting the liquid, provided for each of the nozzles, and a drive-waveform control unit that determines whether to apply a drive waveform having a plurality of pulses in one printing cycle to the pressure generating element and controls a timing to apply the drive waveform to the pressure generating element. The device selects a desired pulse from the drive waveform, applies a selected pulse to the pressure generating element, and ejects liquid drops of different sizes from a same nozzle for each printing cycle based on the selected pulse. The device further includes a setting unit that sets timings for the drive-waveform control unit to turn off the drive waveform such that some of the timings are concentrated at a specific position of the drive waveform where a relatively long time with substantially no voltage fluctuation can be ensured and a selecting unit that sequentially selects pulses present before the specific position in time from the specific position. The device applies a pulse selected by the selecting unit to the pressure generating element.

Furthermore, according to another aspect of the present invention, there is provided a method of driving a liquid-drop ejection head that includes a plurality of nozzles each ejecting liquid, a pressure generating element that generates pressure for ejecting the liquid, provided for each of the nozzles, and a drive-waveform control unit that determines whether to apply a drive waveform having a plurality of pulses in one printing cycle to the pressure generating element and controls a timing to apply the drive waveform to the pressure generating element. A desired pulse is selected from the drive waveform. A selected pulse is applied to the pressure generating element. Liquid drops of different sizes are ejected from a same nozzle for each printing cycle based on the selected pulse. The device includes setting timings for the drive-waveform control unit to turn off the drive waveform such that some of the timings are concentrated at a specific position of the drive waveform where a relatively long time with substantially no voltage fluctuation can be ensured, selecting sequentially pulses present before the specific position in time from the specific position, and applying a pulse selected by the selecting unit to the pressure generating element.

Moreover, according to still another aspect of the present invention, there is provided an image forming apparatus that includes a device for driving a liquid-drop ejection head that includes a plurality of nozzles each ejecting liquid, a pressure generating element that generates pressure for ejecting the liquid, provided for each of the nozzles, and a drive-waveform control unit that determines whether to apply a drive waveform having a plurality of pulses in one printing cycle to the pressure generating element and controls a timing to apply the drive waveform to the pressure generating element. The device selects a desired pulse from the drive waveform, applies a selected pulse to the pressure generating element, and ejects liquid drops of different sizes from a same nozzle for each printing cycle based on the selected pulse. The device further includes a setting unit that sets timings for the drive-waveform control unit to turn off the drive waveform such that some of the timings are concentrated at a specific position of the drive waveform where a relatively long time with substantially no voltage fluctuation can be ensured and a selecting unit that sequentially selects pulses present before the specific position in time from the specific position. The device applies a pulse selected by the selecting unit to the pressure generating element. The liquid to be ejected is ink.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
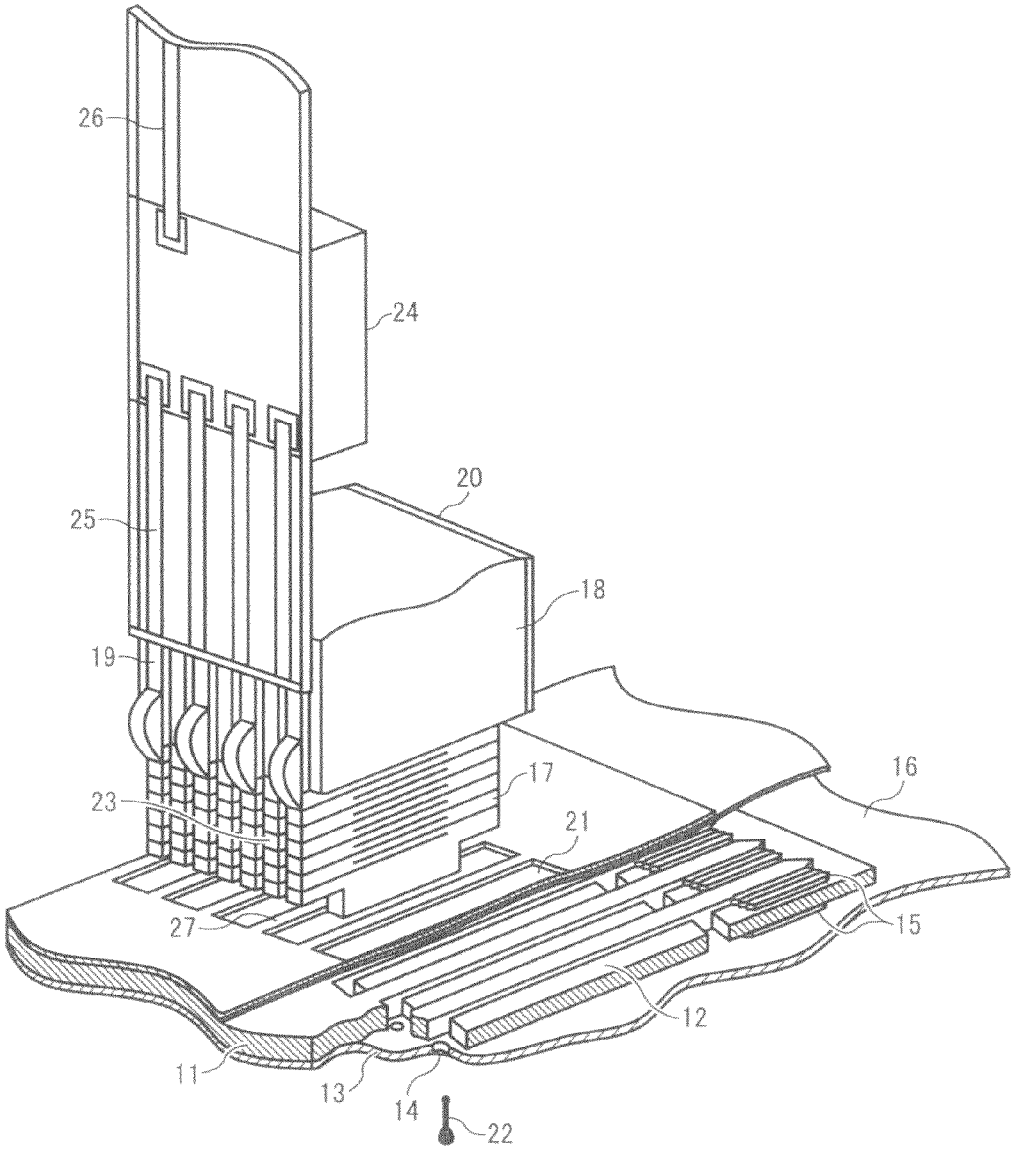
FIG. 1 is a partial perspective view of an inkjet head to which an embodiment of the present invention is applied.
Figure 2:
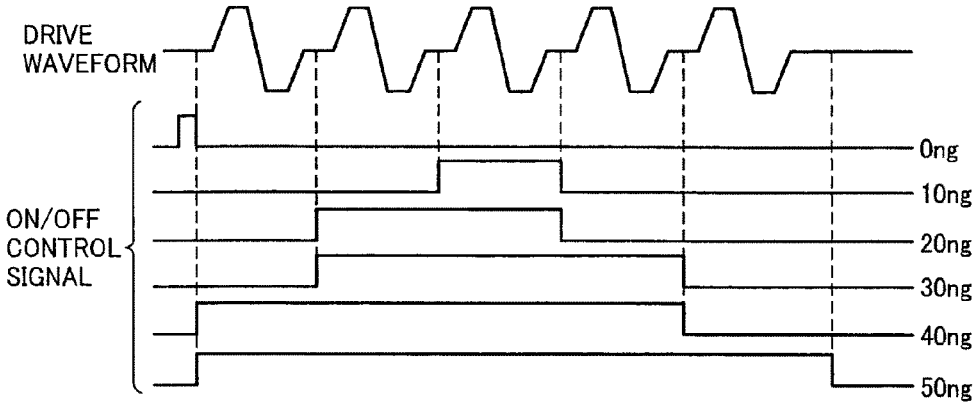
FIG. 2 is a schematic diagram for explaining a driving method of a drive unit of an inkjet head according to a conventional example.
Figure 3:
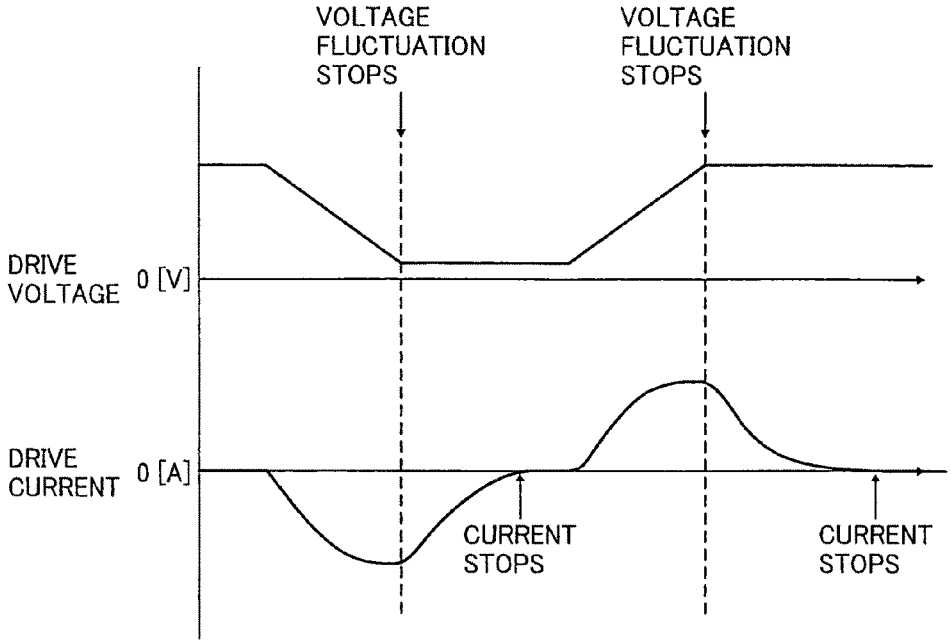
FIG. 3 is a schematic diagram for explaining a relation between a drive voltage and a drive current.
Figure 4:
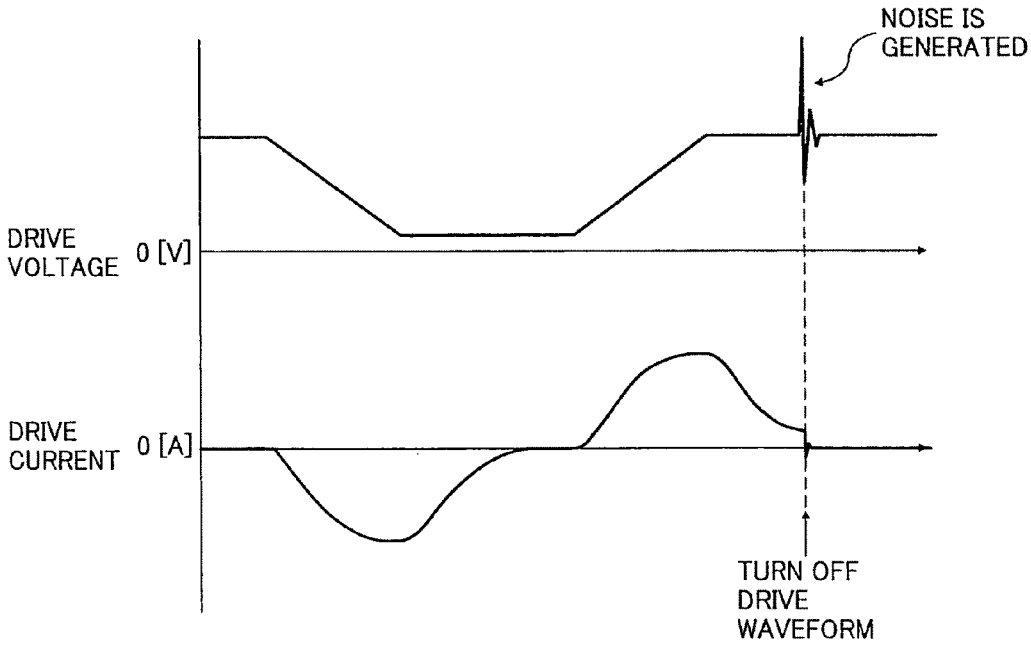
FIG. 4 is another schematic diagram for explaining a relation between a drive voltage and a drive current.

Exemplary embodiments of the present invention will be explained below in detail with reference to the accompanying drawings. FIG. 1 is a partial perspective view of a configuration example of an inkjet head to which an embodiment of the present invention is applied.

An ink pressure chamber 12 is formed in an ink-flow-path forming member 11, and one end of the ink pressure chamber 12 is communicated with a nozzle 14 opened in a nozzle plate 13. The other end of the ink pressure chamber 12 is communicated with a common ink-flow path 16 through a restrictor 15 at a position where an ink flow path is narrowed to prevent pressure applied to ink from being weakened.

As an element for generating pressure for ejecting the ink, a piezoelectric element 17 having a laminated structure is used. The piezoelectric element 17 is fixed to a piezoelectric-element support plate 18 provided in a laminating direction, and generates pressure by using piezoelectric expansion and contraction in a d33 direction. Therefore, when a voltage to be applied to individual electrodes 19 provided in a positive electrode of the piezoelectric element 17 drops to discharge the piezoelectric element 17, the piezoelectric element 17 contracts to decompress the ink pressure chamber 12, and when the voltage to be applied to the individual electrodes 19 rises to charge the piezoelectric element 17, the piezoelectric element 17 expands to pressurize the ink pressure chamber 12.

The individual electrodes 19 are provided on one surface of the piezoelectric-element support plate 18, and connected by soldering with a wiring 25, which is connected to an output terminal of a control element 24 by ultrasonic welding. A wiring 26 connected to an input terminal of a drive voltage of the control element 24 by ultrasonic welding is connected to an output of a drive-waveform generating circuit (not shown). A common electrode 20 provided in a negative electrode of the piezoelectric element 17 is common to the negative electrodes of the respective piezoelectric elements 17, and is provided on the other surface of the piezoelectric-element support plate 18 and connected to a ground of the drive-waveform generating circuit (not shown).

A surface of the piezoelectric element 17 on a side not fixed to the piezoelectric-element support plate 18 is fixed to an elastic film 21. The elastic film 21 forms a part of a wall of the ink pressure chamber 12, and has such a structure that a volume of the ink pressure chamber 12 changes when the elastic film 21 deforms due to expansion and contraction of the piezoelectric element 17.

A piezoelectric element 23 not connected to the wiring 26 is provided adjacent to the piezoelectric element 17 connected to the wiring 26, and a surface of the piezoelectric element 23 not fixed to the piezoelectric-element support plate 18 is fixed to a partition 27 of the ink pressure chamber 12 to contribute to increasing rigidity of the head.

The inkjet head according to the present invention and having the structure described above are arranged in a plurality of numbers in a line with an interval of 1/150 inches.

A principle of liquid drop ejection of the inkjet head is explained next.

The wiring 26 supplied with a drive voltage is connected only to the individual electrodes 19 of the piezoelectric element 17 corresponding to nozzles to eject liquid drops, according to data transmitted from a high-order controller (not shown) by the control element 24 connected to the individual electrodes 19 of the piezoelectric element 17, so that charge and discharge of the piezoelectric element 17 are performed by the voltage applied to the individual electrodes 19.

The piezoelectric element 17 of the nozzle that does not eject liquid drops applies a DC voltage to the individual electrodes 19 to prevent natural discharge, and the piezoelectric element 17 is charged up to a state extended more than a natural length (a length when a voltage is not applied) in the laminating direction, so that the elastic film 21 is substantially stationary in a state being pressed into the ink pressure chamber 12. When the voltage applied to the individual electrodes 19 drops, discharge is performed to contract the piezoelectric element 17 in the laminating direction. Accordingly, the elastic film 21 is pulled to decompress the ink pressure chamber 12, so that the ink is supplied to the ink pressure chamber 12 from the common ink-flow path 16 through the restrictor 15.

Subsequently, when the voltage applied to the individual electrodes 19 rises, the piezoelectric element 17 is charged, and extended in the laminating direction to press the elastic film 21 into the ink pressure chamber 12. Accordingly, the ink in the ink pressure chamber 12 is pressurized and pushed out from the nozzle 14 communicated with the ink pressure chamber 12, to eject the ink as a liquid drop 22.

The inkjet head is designed such that in a decompression process of the ink pressure chamber 12, surface tension acting on the nozzle 14 is larger than resistance of a flow path of the restrictor 15. Therefore, the air is not attracted from the nozzle 14, but the ink is supplied to the ink pressure chamber 12. On the other hand, in a pressurizing process of the ink pressure chamber 12, the surface tension acting on the nozzle 14 is smaller than the resistance of the flow path of the restrictor 15. Therefore, the ink does not return to the common ink-flow path 16 from the restrictor 15, but the liquid drop is ejected from the nozzle 14.

Further, the control element 24 can control a timing to connect the wiring 26 supplied with the drive voltage to the individual electrodes 19 of the piezoelectric element 17. The individual electrodes 19 of the piezoelectric element 17 and the wiring 26 supplied with the drive voltage are connected when an ON/OFF control signal input to the control element 24 from the high-order controller (not shown) is at a HIGH level, and disconnected at the time of LOW level. A plurality of types of ON/OFF control signals are input, and it is determined according to the data transmitted from the high-order controller (not shown) which nozzle is controlled according to the timing of which ON/OFF control signal.

For example, in a case that there are three data signals, six ON/OFF control signals, and a 5-pulse drive waveform in one printing cycle, a timing at which an ON/OFF control signal becomes HIGH is set so that an ON/OFF control signal 0 selects zero pulse, an ON/OFF control signal 1 selects one pulse, an ON/OFF control signal 2 selects two pulses, an ON/OFF control signal 3 selects three pulses, an ON/OFF control signal 4 selects four pulses, and an ON/OFF control signal 5 selects five pulses. The control element 24 controls to apply the drive waveform to the piezoelectric element 17 according to the ON/OFF control signal 0 when the data is set to be (0, 0, 0) for each nozzle, according to the ON/OFF control signal 1 when the data is set to be (1, 0, 0), according to the ON/OFF control signal 2 when the data is set to be (0, 1, 0), according to the ON/OFF control signal 3 when the data is set to be (1, 1, 0), according to the ON/OFF control signal 4 when the data is set to be (0, 0, 1), and according to the ON/OFF control signal 5 when the data is set to be (1, 0, 1).

Therefore, when the data is set to be (0, 0, 0), any liquid drop is not ejected, when the data is set to be (1, 0, 0), a very small liquid drop is ejected, when the data is set to be (0, 1, 0), a small liquid drop is ejected, when the data is set to be (1, 1, 0), a medium-size liquid drop is ejected, when the data is set to be (0, 0, 1), a large liquid drop is ejected, and when the data is set to be (1, 0, 1), a very large liquid drop is ejected. The data is reset for each printing cycle. By having such a configuration, five types of liquid drops having different sizes can be ejected for each printing cycle from the same nozzle, and an image is formed by 6 gray scales including a case of not ejecting liquid drops.

A method of combining a plurality of ejected liquid drops in the air or landing the liquid drops close to each other is explained with reference to FIG. 5, in a case that the voltage waveform in which respective pulses have the same shape is used, and liquid drops of different sizes are ejected for each printing cycle from the same nozzle by varying the number of pulses to be applied to the pressure generating element.

Figure 5:
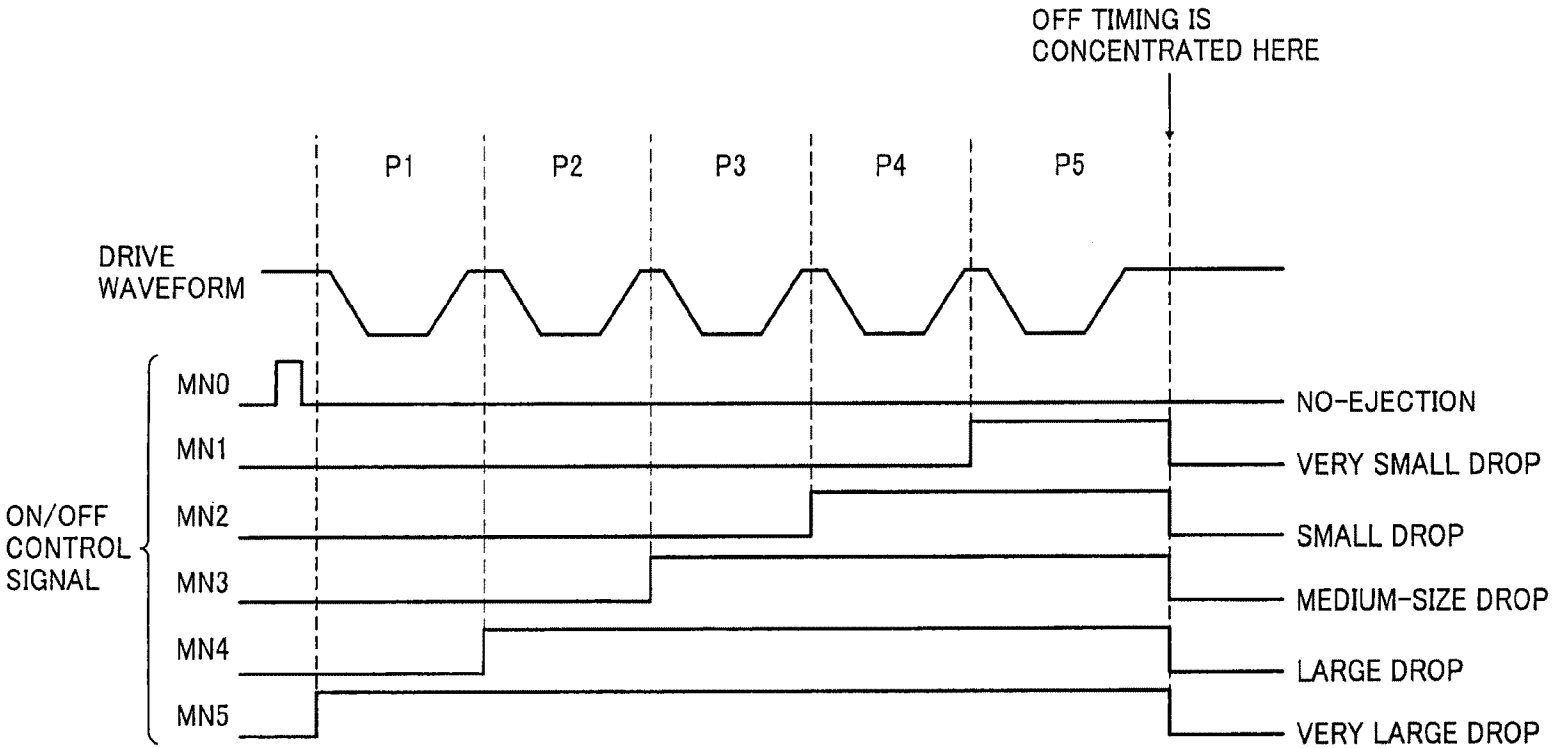
FIG. 5 is a schematic diagram for explaining a relation between a drive waveform and an ON/OFF control signal according to a first embodiment of the present invention for one printing cycle.

FIG. 5 is a schematic diagram for explaining a relation between the drive waveform and the ON/OFF control signal according to a first embodiment of the present invention. As shown in FIG. 5, when only a pulse P5 is applied to the pressure generating element to eject liquid drops, dots of a very small size can be formed on the recording medium. When a pulse P4 and the pulse P5 are applied to the pressure generating element to eject the liquid drops, if the pulse P5 is applied at a timing of reinforcing meniscus vibrations with respect to residual vibration generated in a meniscus due to ejection of liquid drops by application of the pulse P4, the rate of a liquid drop ejected by application of the pulse P5 can be made faster than that of a liquid drop ejected by application of the pulse P4. Accordingly, the liquid drop ejected by application of the pulse P4 and the liquid drop ejected by application of the pulse P5 can be combined before landing on the recording medium to form one small size dot, or the liquid drops land substantially at the same position on the recording medium to form a small size dot.

Further, when a pulse P3, the pulse P4, and the pulse P5 are applied to the pressure generating element to eject liquid drops, if the pulse P4 is applied at the timing of reinforcing meniscus vibrations with respect to residual vibration generated in the meniscus due to ejection of liquid drops by application of the pulse P3, and the pulse P5 is applied at a timing of further reinforcing meniscus vibrations with respect to the residual vibration generated in the meniscus due to ejection of the liquid drops by application of the pulses P3 and P4, the rate of the liquid drop ejected by application of the pulse P4 can be made faster than that of the liquid drop ejected by application of the pulse P3, and the rate of the liquid drop ejected by application of the pulse P5 can be made much faster. Accordingly, the liquid drop ejected by application of the pulse P3, the liquid drop ejected by application of the pulse P4, and the liquid drop ejected by application of the pulse P5 can be combined before landing on the recording medium to form one medium size dot, or the liquid drops land substantially at the same position on the recording medium to form a medium size dot.

When a pulse P2 and the pulses P3 to P5 are applied to the pressure generating element to eject liquid drops according to the same design, a plurality of ejected liquid drops can be combined before landing on the recording medium to form one large dot, or the liquid drops land substantially at the same position on the recording medium to form a large dot. When a pulse P1 and the pulses P2 to P5 are applied to the pressure generating element to eject the liquid drops according to the same design, a plurality of ejected liquid drops can be combined before landing on the recording medium to form one very large dot, or the liquid drops land substantially at the same position on the recording medium to form a very large dot.

When the drive waveform is designed according to such a principle, the interval between the pulses becomes narrow. For example, in the inkjet head according to the first embodiment, the interval between the pulses P1 and P2 is 2.8 microseconds, the interval between the pulses P2 and P3 is 2 microseconds, the interval between the pulses P3 and P4 is 1.7 microseconds, and the interval between the pulses P4 and P5 is 1.0 microsecond.

On the other hand, to decrease the noise up to a level at which no problem occurs at the time of turning off the drive waveform, the drive waveform needs to be turned off after a period of time since a voltage of the drive waveform becomes substantially constant until the current of the drive waveform does not flow substantially. Until the voltage of the drive waveform is changed again, reaction time of the control element is required from a turning-off timing of the drive waveform. Therefore, the interval between the pulses required at the time of turning off the drive waveform needs to be more than time obtained by adding the time since the voltage of the drive waveform becomes substantially constant until the current of the drive waveform does not flow substantially and the reaction time of the control element. For example, in the inkjet head according to the first embodiment, the interval is 1.8 microseconds. Therefore, if the timing to turn off the drive waveform is set to between the pulses P1 and P2, between the pulses P2 and P3, or behind the pulse P5, the inkjet head can be driven without generating the noise at a level that causes a problem in the drive waveform. In this example, a specific position described in the appended claims 1 to 3 corresponds to behind the pulse P5, and a second specific position described in the appended claim 3 corresponds to between the pulses P1 and P2, and between the pulses P2 and P3.

When the drive waveform is turned on, even if the drive waveform is turned on during the current is still flowing, noise is not generated in the drive waveform, except of a case that a current considerably larger than a current in which noise is generated at the time of turning off is abruptly made to flow. Therefore, the interval between the pulses required for turning on the drive waveform is only the reaction time of the control element. For example, in the inkjet head according to the first embodiment, because the reaction time is 0.3 microsecond, the drive current can be turned on anywhere before the pulse P1, between respective pulses of from the pulse P1 to the pulse P5, and behind the pulse P5.

The first embodiment is explained in more detail with reference to FIG. 5, taking the above features into consideration.

FIG. 5 is a schematic diagram for explaining the drive waveform and ON/OFF control signals MN0 to MN5 of the drive waveform for one printing cycle, in the case of performing image formation with 6 gray scales. The pulses P1 to P5 shown in FIG. 5 are continuous pulses of the same shape. The pulse P1 is present before the pulse P5 timewise.

The timing when the ON/OFF control signal is changed from HIGH to LOW, which is the timing to turn off the drive waveform, is set to be concentrated behind the pulse P5 for MN1 to MN5, and the ON/OFF control signal MN1 is HIGH from a start of the pulse P5 to an end of the pulse P5, and it is used at the time of ejecting a very small liquid drop, because the pulse P5 is selected.

The ON/OFF control signal MN2 is HIGH from the start of the pulse P4 to the end of the pulse P5, and it is used at the time of ejecting a small liquid drop, because the pulses P4 and P5 are selected. The ON/OFF control signal MN3 is HIGH from the start of the pulse P3 to the end of the pulse P5, and it is used at the time of ejecting a medium-size liquid drop, because the pulses P3 to P5 are selected. The ON/OFF control signal MN4 is HIGH from the start of the pulse P2 to the end of the pulse P5, and it is used at the time of ejecting a large liquid drop, because the pulses P2 to P5 are selected. The ON/OFF control signal MN5 is HIGH from the start of the pulse P1 to the end of the pulse P5, and it is used at the time of ejecting a very large liquid drop, because the pulses P1 to P5 are selected. The ON/OFF control signal MN0 is a signal for a no-ejection pulse, and it functions to prevent that a piezoelectric element not to be driven returns to the natural length due to natural discharge by being turned on at a timing when the drive waveform is constant at the voltage at the time of waiting for ejection, to perform auxiliary charge. The ON/OFF control signal MN0 is used at the time of not ejecting liquid drops, because it does not select any pulse.

The timing to turn off the drive waveform is after a moment when the current of the drive waveform decreases to a level at which noise of a size that causes a problem is not generated even if the drive waveform is turned off. In the inkjet head according to the present invention, it is after 1.5 microseconds or more after the voltage of the pulse becomes substantially constant. However, this value varies according to the type of the pressure generating element, the constant, the number of driving nozzles, the drive waveform, the circuit or the like.

It is further desirable if the timing to turn off the drive waveform can be set after a moment when the current flowing to the pressure generating element decreases to a level at which noise is not generated even when the drive waveform is turned off, after the voltage of the pulse becomes substantially constant. In the inkjet head according to the first embodiment, the time is after 2.2 microseconds or more after the voltage of the pulse becomes substantially constant.

The timing to turn on the drive waveform is before a voltage of each pulse starts to change by more than the reaction time of the control element. In the inkjet head used for experiments this time, it is 0.3 microsecond or more before the voltage of each pulse starts to change. This value varies according to the control element, the circuit or the like.

The control element selects the ON/OFF control signal for each nozzle according to the set data, and applies the drive waveform to the piezoelectric element according to the ON/OFF control signal, to perform gray scale recording. In the first embodiment, the ON/OFF control signal as explained with reference to FIG. 5 and therefore an ON/OFF control-signal generator, and the control element also serve as a setting unit that sets the timing to turn off the drive waveform to be concentrated on a specific position of the drive waveform of the plurality of pulses where a long time with substantially no voltage fluctuation can be ensured, and a selecting unit that sequentially selects a pulse present before a specific position timewise starting from the specific position.

Figure 6:
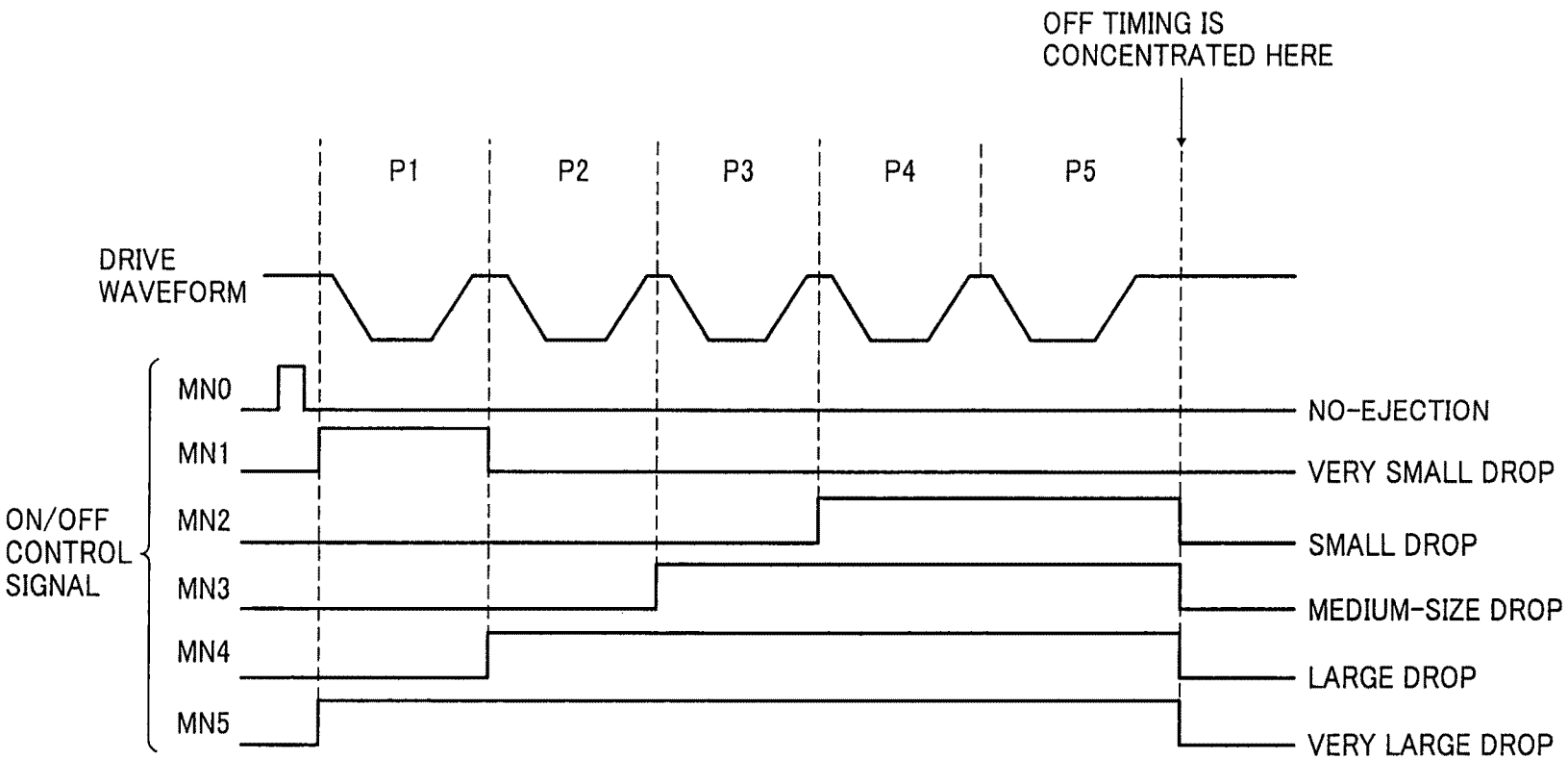
FIG. 6 is a schematic diagram for explaining a relation between a drive waveform and an ON/OFF control signal according to a second embodiment of the present invention for one printing cycle.

A second embodiment of the present invention is explained next with reference to FIG. 6. FIG. 6 is a schematic diagram for explaining the drive waveform and the ON/OFF control signals MN0 to MN5 of the drive waveform for one printing cycle, in the case of performing image formation with 6 gray scales.

Pulses P1 to P5 shown in FIG. 6 are continuous pulses of the same shape. The pulse P1 is present before the pulse P5 timewise. The ejection timing of the liquid drop by application of the pulse P2 is later than that by application of the pulse P1, the ejection timing of the liquid drop by application of the pulse P3 is later than that by application of the pulse P2, the ejection timing of the liquid drop by application of the pulse P4 is later than that by application of the pulse P3, and the ejection timing of the liquid drop by application of the pulse P5 is later than that by application of the pulse P4.

A timing when the ON/OFF control signal is changed from HIGH to LOW, which is the timing to turn off the drive waveform, is set to be concentrated behind the pulse P5 for MN2 to MN5, and between the pulses P1 and P2 for MN1.

The ON/OFF control signal MN1 is HIGH from the start of the pulse P1 to the end of the pulse P1, and it is used at the time of ejecting a very small liquid drop, because the pulse P1 is selected. The ON/OFF control signal MN2 is HIGH from the start of the pulse P4 to the end of the pulse P5, and it is used at the time of ejecting a small liquid drop, because the pulses P4 and P5 are selected. The ON/OFF control signal MN3 is HIGH from the start of the pulse P3 to the end of the pulse P5, and it is used at the time of ejecting a medium-size liquid drop, because the pulses P3 to P5 are selected.

The ON/OFF control signal MN4 is HIGH from the start of the pulse P2 to the end of the pulse P5, and it is used at the time of ejecting a large liquid drop, because the pulses P2 to P5 are selected. The ON/OFF control signal MN5 is HIGH from the start of the pulse P1 to the end of the pulse P5, and it is used at the time of ejecting a very large liquid drop, because the pulses P1 to P5 are selected. The ON/OFF control signal MN0 functions to prevent that a piezoelectric element not to be driven returns to the natural length due to natural discharge by being turned on at the timing when the drive waveform is constant at the voltage at the time of waiting for ejection, to perform auxiliary charge. The ON/OFF control signal MN0 is used at the time of not ejecting liquid drops, because it does not select any pulse.

The timing to turn off the drive waveform is after a moment when the current of the drive waveform decreases to a level at which noise of a size that causes a problem is not generated even if the drive waveform is turned off. In the inkjet head according to the present invention, it is after 1.5 microseconds or more after the voltage of the pulse becomes substantially constant. However, this value varies according to the type of the pressure generating element, the constant, the number of driving nozzles, the drive waveform, the circuit or the like.

It is further desirable if the timing to turn off the drive waveform can be set after a moment when the current flowing to the pressure generating element decreases to a level at which noise is not generated even when the drive waveform is turned off, after the voltage of the pulse becomes substantially constant. In the inkjet head according to the first embodiment, the time is after 2.2 microseconds or more after the voltage of the pulse becomes substantially constant.

The timing to turn on the drive waveform is before a voltage of each pulse starts to change by more than the reaction time of the control element. In the inkjet head used for experiments this time, it is 0.3 microsecond or more before the voltage of each pulse starts to change. This value varies according to the control element, the circuit or the like.

The control element selects the ON/OFF control signal for each nozzle according to the set data, and applies the drive waveform to the piezoelectric element according to the ON/OFF control signal, to perform gray scale recording. In the second embodiment, the ON/OFF control signal as explained with reference to FIG. 6 and therefore an ON/OFF control-signal generator, and the control element also serve as a setting unit that sets the timing to turn off the drive waveform to be concentrated on a specific position of the drive waveform of the plurality of pulses where a long time with substantially no voltage fluctuation can be ensured, and a selecting unit that sequentially selects a pulse present before a specific position timewise starting from the specific position.

Because the drive pulses of the number corresponding to an amount of the liquid drop to be ejected are sequentially supplied to the pressure generating element from the plurality of drive pulses in the printing cycle, an ejection timing of an ink drop varies according to which a drive pulse is to be supplied. When it is set that the rate of the liquid drop to be ejected next becomes faster than that of the liquid drop ejected previously to combine the liquid drops before landing on the recording medium as in the first embodiment, a very small liquid drop ejected by applying only the pulse P5 lands on the recording medium far behind with respect to a very large liquid drop ejected by applying the pulses P1 to P5, because the ejection timing is later than the pulse P1 and there is no acceleration of the liquid drop. As a result, there is such a problem that a misregistration of the ink drop occurs to degrade printing quality. However, according to the above configuration, this problem can be improved because an ejection start timing of the very small liquid drop is quickened.

For example, the first embodiment explained with reference to FIG. 5 is applied to the inkjet head according to the present invention, the timing of the liquid drop ejected by applying the pulses P2 to P5 to land on the recording medium is behind for 5.1 microseconds with respect to the timing of the liquid drop ejected by applying the pulses P1 to P5 to land on the recording medium. The timing of the liquid drop ejected by applying the pulses P3 and P5 to land on the recording medium is behind for 14.9 microseconds, the timing of the liquid drop ejected by applying the pulses P4 and P5 to land on the recording medium is behind for 29.4 microseconds, and the timing of the liquid drop ejected by applying the pulse P1 to land on the recording medium is behind for 64.1 microseconds. When one printing cycle is 50 microseconds, a landing misregistration by performing the gray scale recording is up to about ±0.6 dot.

However, when the second embodiment explained with reference to FIG. 6 is applied thereto, the timing of the liquid drop ejected by applying the pulses P2 to P5 to land on the recording medium is behind for 5.1 microseconds with respect to the timing of the liquid drop ejected by applying the pulses P1 to P5 to land on the recording medium. The timing of the liquid drop ejected by applying the pulses P3 and P5 to land on the recording medium is behind for 14.9 microseconds, and the timing of the liquid drop ejected by applying the pulses P4 and P5 to land on the recording medium is behind for 29.4 microseconds. However, the timing of the liquid drop ejected by applying the pulse P1 to land on the recording medium is only behind for 28.6 microseconds. When one printing cycle is 50 microseconds, the landing misregistration by performing the gray scale recording can be suppressed to up to about ±0.3 dot.

Figure 7:
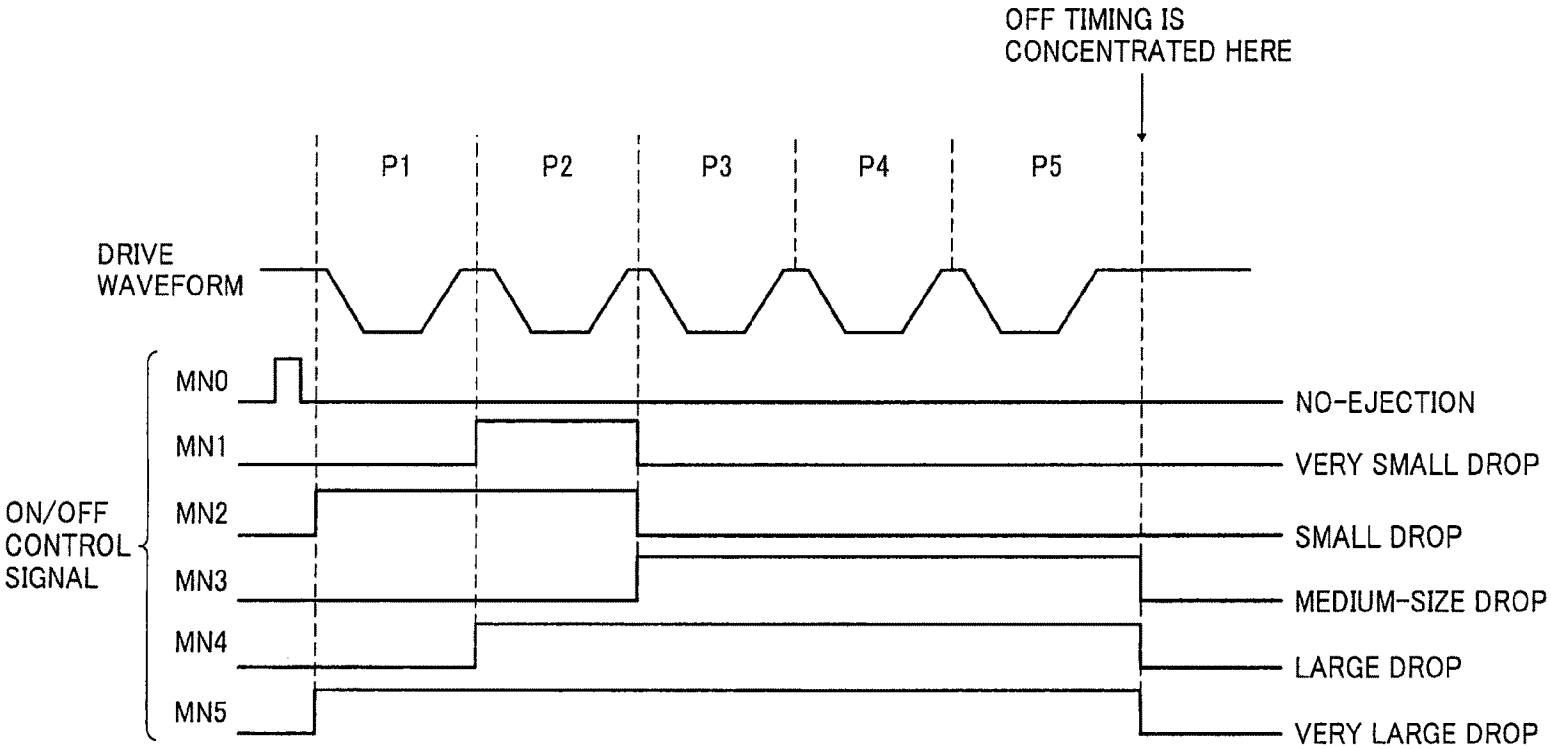
FIG. 7 is a schematic diagram for explaining a relation between a drive waveform and an ON/OFF control signal according to a third embodiment of the present invention for one printing cycle.

A third embodiment of the present invention is explained with reference to FIG. 7. FIG. 7 is a schematic diagram for explaining the drive waveform and the ON/OFF control signals MN0 to MN5 of the drive waveform for one printing cycle, in the case of performing image formation with 6 gray scales. The third embodiment is different from the second embodiment explained with reference to FIG. 6 in that the second specific position in the appended claims is set between the pulses P2 and P3.

Pulses P1 to P5 shown in FIG. 7 are continuous pulses of the same shape. The pulse P1 is present before the pulse P5 timewise. The ejection timing of the liquid drop by application of the pulse P2 is later than that by application of the pulse P1, the ejection timing of the liquid drop by application of the pulse P3 is later than that by application of the pulse P2, the ejection timing of the liquid drop by application of the pulse P4 is later than that by application of the pulse P3, and the ejection timing of the liquid drop by application of the pulse P5 is later than that by application of the pulse P4. The timing when the ON/OFF control signal is changed from HIGH to LOW, which is the timing to turn off the drive waveform, is set to be concentrated behind the pulse P5 for MN3 to MN5, and between the pulses P2 and P3 for MN1 and MN2.

The ON/OFF control signal MN1 is HIGH from the start of the pulse P2 to the end of the pulse P2, and it is used at the time of ejecting a very small liquid drop, because the pulse P2 is selected. The ON/OFF control signal MN2 is HIGH from the start of the pulse P1 to the end of the pulse P2, and it is used at the time of ejecting a small liquid drop, because the pulses P1 and P2 are selected. The ON/OFF control signal MN3 is HIGH from the start of the pulse P3 to the end of the pulse P5, and it is used at the time of ejecting a medium-size liquid drop, because the pulses P3 to P5 are selected.

The ON/OFF control signal MN4 is HIGH from the start of the pulse P2 to the end of the pulse P5, and it is used at the time of ejecting a large liquid drop, because the pulses P2 to P5 are selected. The ON/OFF control signal MN5 is HIGH from the start of the pulse P1 to the end of the pulse P5, and it is used at the time of ejecting a very large liquid drop, because the pulses P1 to P5 are selected. The ON/OFF control signal MN0 functions to prevent that a piezoelectric element not to be driven returns to the natural length due to natural discharge by being turned on at a timing when the drive waveform is constant at the voltage at the time of waiting for ejection, to perform auxiliary charge. The ON/OFF control signal MN0 is used at the time of not ejecting liquid drops, because it does not select any pulse.

The timing to turn off the drive waveform is after a moment when the current of the drive waveform decreases to a level at which noise of a size that causes a problem is not generated even if the drive waveform is turned off. In the inkjet head according to the present invention, it is after 1.5 microseconds or more after the voltage of the pulse becomes substantially constant. However, this value varies according to the type of the pressure generating element, the constant, the number of driving nozzles, the drive waveform, the circuit or the like.

It is further desirable if the timing to turn off the drive waveform can be set after a moment when the current flowing to the pressure generating element decreases to a level at which noise is not generated even when the drive waveform is turned off, after the voltage of the pulse becomes substantially constant. In the inkjet head according to the first embodiment, the time is after 2.2 microseconds or more after the voltage of the pulse becomes substantially constant.

The timing to turn on the drive waveform is before a voltage of each pulse starts to change by more than the reaction time of the control element. In the inkjet head used for experiments this time, it is 0.3 microsecond or more before the voltage of each pulse starts to change. This value varies according to the control element, the circuit or the like.

The control element selects the ON/OFF control signal for each nozzle according to the set data, and applies the drive waveform to the piezoelectric element according to the ON/OFF control signal, to perform gray scale recording. In the third embodiment, the ON/OFF control signal as explained with reference to FIG. 7 and therefore an ON/OFF control-signal generator, and the control element also serve as a setting unit that sets the timing to turn off the drive waveform to be concentrated on a specific position of the drive waveform of the plurality of pulses where a long time with substantially no voltage fluctuation can be ensured, and a selecting unit that sequentially selects a pulse present before a specific position timewise starting from the specific position.

Because the drive pulses of the number corresponding to the amount of the liquid drop to be ejected are sequentially supplied to the pressure generating element from the plurality of drive pulses in the printing cycle, an ejection timing of an ink drop varies according to which a drive pulse is to be supplied. When it is set that the rate of the liquid drop to be ejected next becomes faster than that of the liquid drop ejected previously to combine the liquid drops before landing on the recording medium as in the first embodiment, a very small liquid drop ejected by applying only the pulse P5 and a small liquid drop ejected by applying the pulses P4 and P5 land on the recording medium far behind with respect to a very large liquid drop ejected by applying the pulses P1 to P5, because the ejection timing is later than the pulse P1 and there is no or little acceleration of the liquid drop. As a result, there is such a problem that a misregistration of the ink drop occurs to degrade the printing quality. However, according to the above configuration, this problem can be improved because an ejection start timing of the very small liquid drop and the small liquid drop is quickened.

A fourth embodiment of the present invention is explained with reference to FIG. 8.

Figure 8:
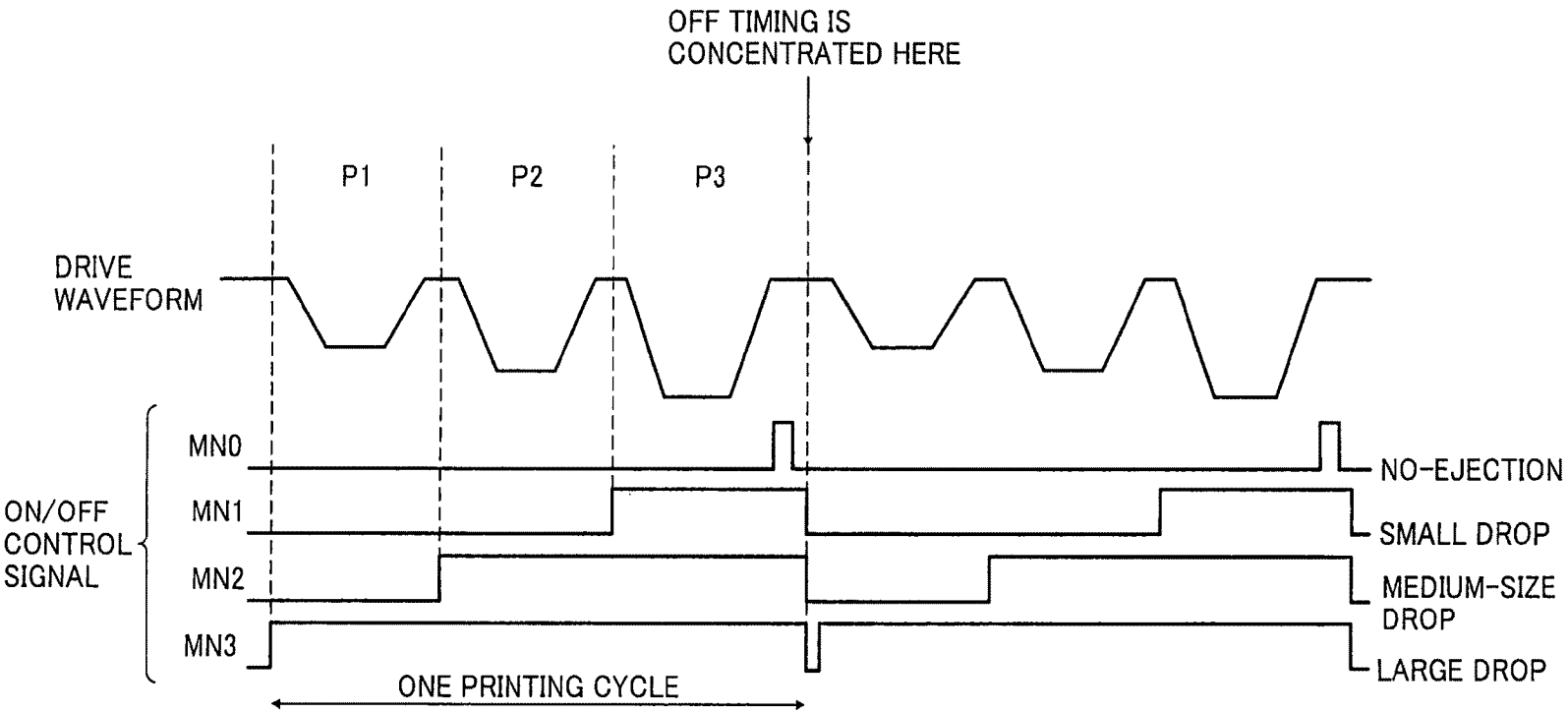
FIG. 8 is a schematic diagram for explaining a relation between a drive waveform and an ON/OFF control signal according to a fourth embodiment of the present invention for one printing cycle.

As shown in FIG. 8, because the drive waveform has three pulses at which the voltage gradually rises in one printing cycle, the liquid drop ejected by the pulse P2 is faster than the liquid drop ejected by the pulse P1, and the liquid drop ejected by the pulse P3 is much faster than the liquid drop ejected by the pulse P2. Therefore, the liquid drops ejected in one printing cycle are combined in the air to land on the recording medium, or land on the recording medium close to each other. Because one printing cycle is short by increasing a drive frequency, the interval between the pulses P1 and P2 and the interval between the pulses P2 and P3 are narrow. When the drive waveform is turned off, therefore, noise may be generated in the drive waveform. The interval between the pulse P3 and a top pulse in the next printing cycle is set wide.

The timing when the ON/OFF control signal is changed from HIGH to LOW, which is the timing to turn off the drive waveform, is set to be concentrated behind the pulse P3 for MN1 to MN3. The ON/OFF control signal MN1 is HIGH from the start of the pulse P3 to the end of the pulse P3, and it is used at the time of ejecting a small liquid drop, because the pulse P3 is selected. The ON/OFF control signal MN2 is HIGH from the start of the pulse P2 to the end of the pulse P3, and it is used at the time of ejecting a medium-size liquid drop, because the pulses P2 and P3 are selected. The ON/OFF control signal MN3 is HIGH from the start of the pulse P1 to the end of the pulse P3, and it is used at the time of ejecting a large liquid drop, because the pulses P1 to P3 are selected. The ON/OFF control signal MN0 functions to prevent that a piezoelectric element not to be driven returns to the natural length due to natural discharge by being turned on at the timing when the drive waveform is constant at the voltage at the time of waiting for ejection, to perform auxiliary charge. The ON/OFF control signal MN0 is used at the time of not ejecting liquid drops, because it does not select any pulse.

The timing to turn off the drive waveform is after a moment when the current of the drive waveform decreases to a level at which noise of a size that causes a problem is not generated even if the drive waveform is turned off. This value varies according to the type of the pressure generating element, the constant, the number of driving nozzles, the drive waveform, the circuit or the like.

It is further desirable if the timing to turn off the drive waveform can be set after a moment when the current flowing to the pressure generating element decreases to a level at which noise is not generated even when the drive waveform is turned off, after the voltage of the pulse becomes substantially constant.

The timing to turn on the drive waveform is before a voltage of each pulse starts to change by more than the reaction time of the control element. In the inkjet head used for experiments this time, it is 0.3 microsecond or more before the voltage of each pulse starts to change. This value varies according to the control element, the circuit or the like.

The control element selects the ON/OFF control signal for each nozzle according to the set data, and applies the drive waveform to the piezoelectric element according to the ON/OFF control signal, to perform gray scale recording. In the fourth embodiment, the ON/OFF control signal as explained with reference to FIG. 8 and therefore an ON/OFF control-signal generator, and the control element also serve as a setting unit that sets the timing to turn off the drive waveform to be concentrated on a specific position of the drive waveform of the plurality of pulses where a long time with substantially no voltage fluctuation can be ensured, and a selecting unit that sequentially selects a pulse present before a specific position timewise starting from the specific position.

Figure 9:
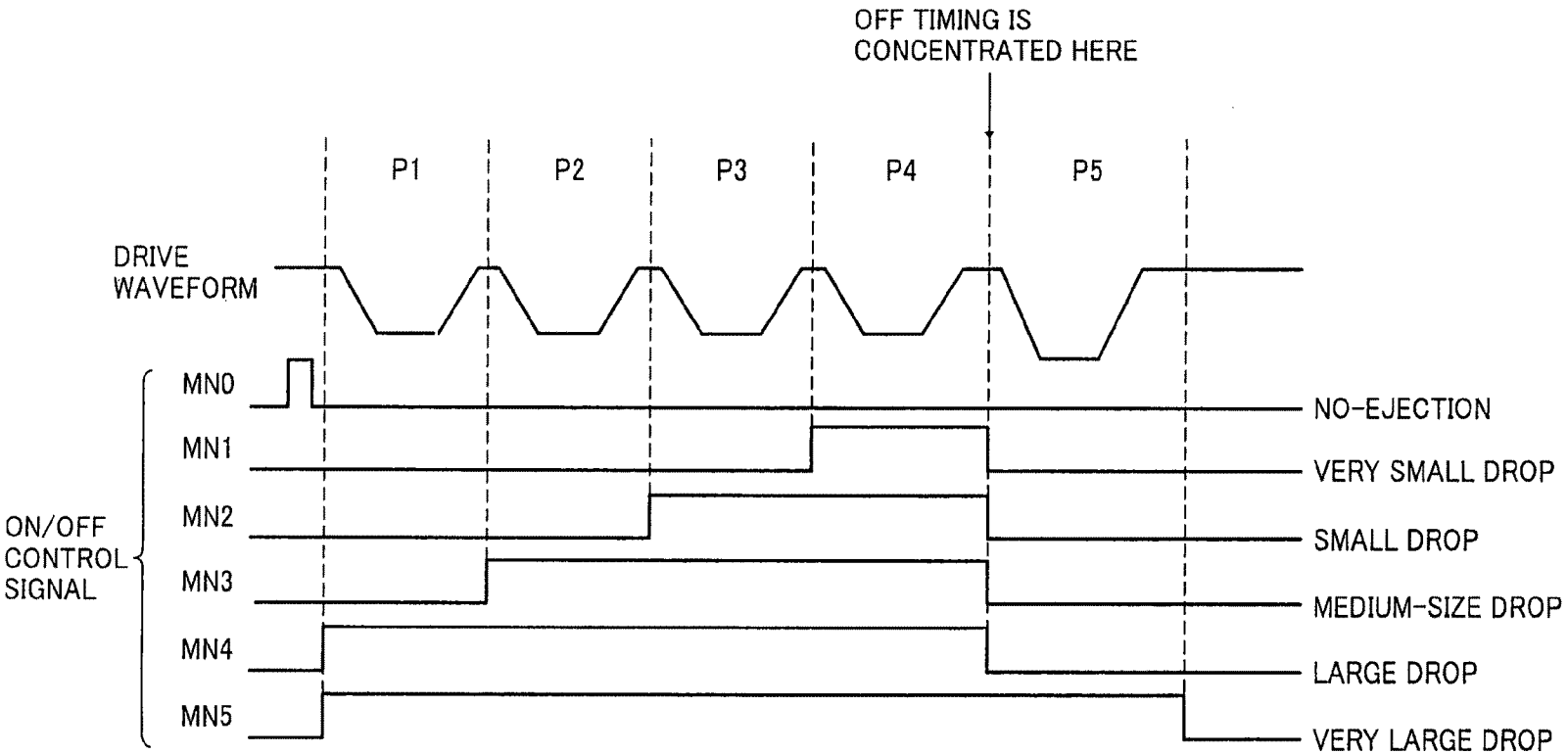
FIG. 9 is a schematic diagram for explaining a relation between a drive waveform and an ON/OFF control signal according to a fifth embodiment of the present invention for one printing cycle.

A fifth embodiment is explained with reference to FIG. 9. FIG. 9 is a schematic diagram for explaining the drive waveform and the ON/OFF control signals MN0 to MN5 of the drive waveform for one printing cycle, in the case of performing image formation with 6 gray scales.

In the pulses P1 to P5 shown in FIG. 9, the interval between the pulses P4 and P5 becomes wide due to a reason that the waveform of the pulse P5 is different from other pulses. The pulse P1 is present before the pulse P5 timewise. The timing when the ON/OFF control signal is changed from HIGH to LOW, which is the timing to turn off the drive waveform, is set to be concentrated between the pulses P4 and P5 for MN1 to MN4, and behind the pulse P5 for MN5.

The ON/OFF control signal MN1 is HIGH from a start of the pulse P4 to an end of the pulse P4, and it is used at the time of ejecting a very small liquid drop, because the pulse P4 is selected. The ON/OFF control signal MN2 is HIGH from the start of the pulse P3 to the end of the pulse P4, and it is used at the time of ejecting a small liquid drop, because the pulses P3 and P4 are selected. The ON/OFF control signal MN3 is HIGH from the start of the pulse P2 to the end of the pulse P4, and it is used at the time of ejecting a medium-size liquid drop, because the pulses P2 to P4 are selected.

The ON/OFF control signal MN4 is HIGH from the start of the pulse P1 to the end of the pulse P4, and it is used at the time of ejecting a large liquid drop, because the pulses P1 to P4 are selected. The ON/OFF control signal MN5 is HIGH from the start of the pulse P1 to the end of the pulse P5, and it is used at the time of ejecting a very large liquid drop, because the pulses P1 to P5 are selected. The ON/OFF control signal MN0 functions to prevent that a piezoelectric element not to be driven returns to the natural length due to natural discharge by being turned on at the timing when the drive waveform is constant at the voltage at the time of waiting for ejection, to perform auxiliary charge. The ON/OFF control signal MN0 is used at the time of not ejecting liquid drops, because it does not select any pulse.

The timing to turn off the drive waveform is after a moment when the current of the drive waveform decreases to a level at which noise of a size that causes a problem is not generated even if the drive waveform is turned off. This value varies according to the type of the pressure generating element, the constant, the number of driving nozzles, the drive waveform, the circuit or the like.

It is further desirable if the timing to turn off the drive waveform can be set after a moment when the current flowing to the pressure generating element decreases to a level at which noise is not generated even when the drive waveform is turned off, after the voltage of the pulse becomes substantially constant.

The timing to turn on the drive waveform is before a voltage of each pulse starts to change by more than the reaction time of the control element. In the inkjet head used for experiments this time, it is 0.3 microsecond or more before the voltage of each pulse starts to change. This value varies according to the control element, the circuit or the like.

The control element selects the ON/OFF control signal for each nozzle according to the set data, and applies the drive waveform to the piezoelectric element according to the ON/OFF control signal, to perform gray scale recording. In the fifth embodiment, the ON/OFF control signal as explained with reference to FIG. 9 and therefore an ON/OFF control-signal generator, and the control element also serve as a setting unit that sets the timing to turn off the drive waveform to be concentrated on a specific position of the drive waveform of the plurality of pulses where a long time with substantially no voltage fluctuation can be ensured, and a selecting unit that sequentially selects a pulse present before a specific position timewise starting from the specific position.

Figure 10:
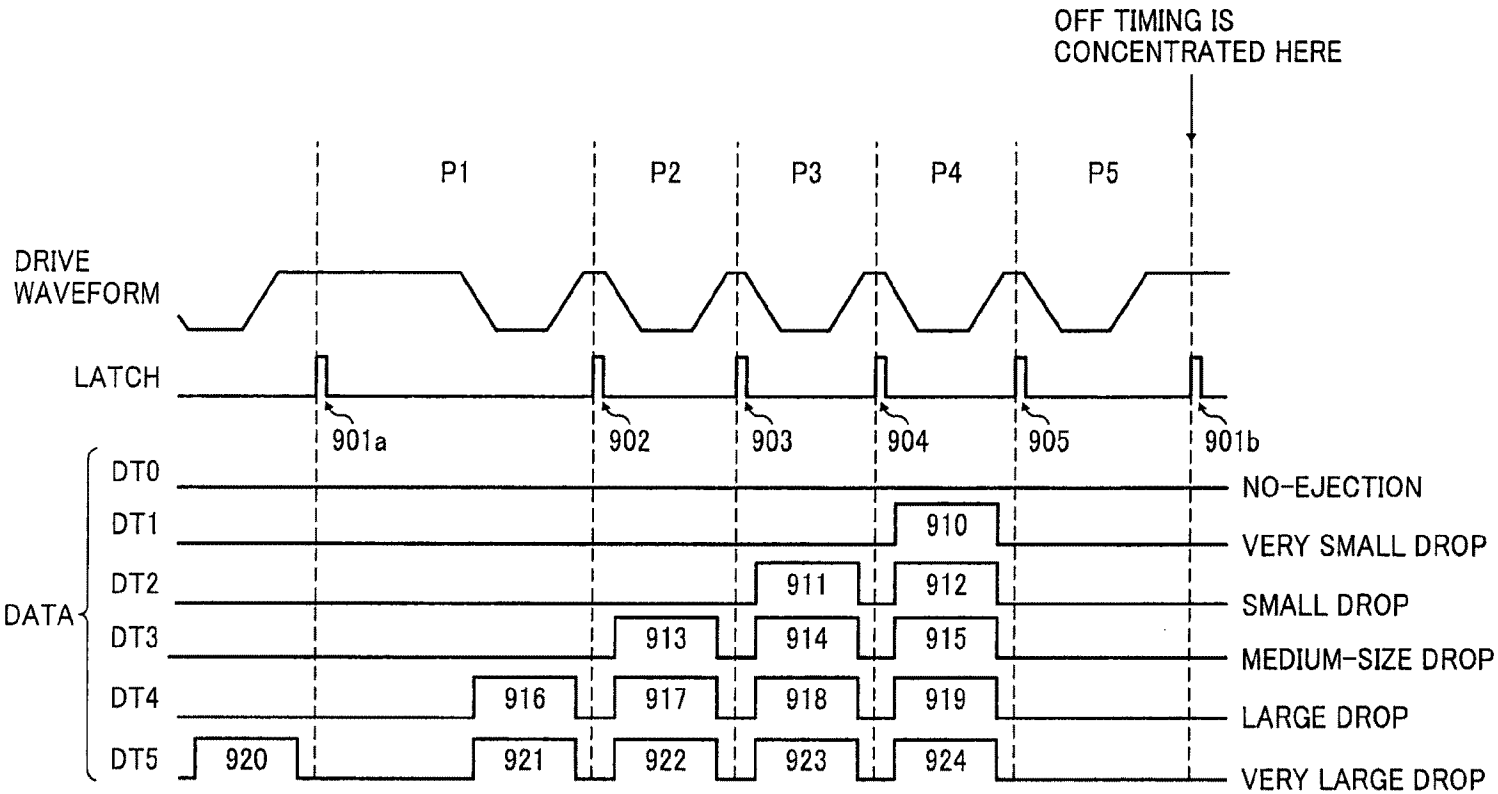
FIG. 10 is a schematic diagram for explaining a relation among a drive waveform, a latch signal, and data according to a sixth embodiment of the present invention for one printing cycle.

A sixth embodiment of the present invention is explained with reference to FIG. 10. FIG. 10 is a schematic diagram for explaining the drive waveform, data patterns DT0 to DT5 of data signals, and a latch signal for latching data for one printing cycle, in the case of performing image formation with 6 gray scales.

A data signal expressing a value to be set for each nozzle by HIGH or LOW is written in a shift register by a clock signal (not shown), and set to an instantaneous register latched at a leading or trailing edge of the latch signal. A nozzle set with 1 is applied to a pressure generating element by turning on the drive waveform until 0 is set thereafter. A nozzle set with 0 is not applied by turning off the drive waveform.

A latch 901*a* is provided between the pulse P1 and the last pulse in the previous printing cycle, a latch 902 is provided between the pulses P1 and P2, a latch 903 is provided between the pulses P2 and P3, a latch 904 is provided between the pulses P3 and P4, a latch 905 is provided between the pulses P4 and P5, and a latch 901*b* is provided between the pulse P5 and the first pulse in the next printing cycle.

The data pattern DT0 is LOW at all times, and in the data pattern DT1, there is data 910, which becomes HIGH between the latches 904 and 905. In the data pattern DT2, there are data 911 that becomes HIGH between the latches 903 and 904 and data 912 that becomes HIGH between the latches 904 and 905. In the data pattern DT3, there are data 913 that becomes HIGH between the latches 902 and 903, data 914 that becomes HIGH between the latches 903 and 904, and data 915 that becomes HIGH between the latches 904 and 905. In the data pattern DT4, there are data 916 that becomes HIGH between the latches 901*a* and 902, data 917 that becomes HIGH between the latches 902 and 903, data 918 that becomes HIGH between the latches 903 and 904, and data 919 that becomes HIGH between the latches 904 and 905. In the data pattern DT5, there are data 920 that becomes HIGH before the latch 901*a*, data 921 that becomes HIGH between the latches 901*a* and 902, data 922 that becomes HIGH between the latches 902 and 903, data 923 that becomes HIGH between the latches 903 and 904, and data 924 that becomes HIGH between the latches 904 and 905.

When data having the data pattern DT0 is transmitted to the control element, 0 is set by all the latches 901*a*, 902, 903, 904, 905, and 901*b*, and no pulse is applied to the pressure generating element, and thus the liquid drop is not ejected. When data having the data pattern DT1 is transmitted to the control element, 0 is set by the latches 901*a*, 902, 903, and 904, and although the pulses P1 to P4 are not applied to the pressure generating element, the data 910 is set to 1 by the latch 905. The drive waveform is turned on at the timing of the latch 905 to apply the pulse P5 to the pressure generating element, thereby ejecting a very small liquid drop. When any very large liquid drop is not ejected in the next printing cycle, 0 is set by the latch 901*b*, thereby turning off the drive waveform at the timing of the latch 901*b*.

When data having the data pattern DT2 is transmitted to the control element, 0 is set by the latches 901*a*, 902, and 903, and although the pulses P1 to P3 are not applied to the pressure generating element, the data 911 is set to 1 by the latch 904 and the data 912 is set to 1 by the latch 905. The drive waveform is turned on at the timing of the latch 904 to apply the pulses P4 and P5 to the pressure generating element, thereby ejecting a small liquid drop. When any very large liquid drop is not ejected in the next printing cycle, 0 is set by the latch 901*b*, thereby turning off the drive waveform at the timing of the latch 901*b*.

When data having the data pattern DT3 is transmitted to the control element, 0 is set by the latches 901*a* and 902, and although the pulses P1 and P2 are not applied to the pressure generating element, the data 913 is set to 1 by the latch 903, the data 914 is set to 1 by the latch 904, and the data 915 is set to 1 by the latch 905. The drive waveform is turned on at the timing of the latch 903 to apply the pulses P3 to P5 to the pressure generating element, thereby ejecting a medium-size liquid drop. When any very large liquid drop is not ejected in the next printing cycle, 0 is set by the latch 901*b*, thereby turning off the drive waveform at the timing of the latch 901*b*.

When data having the data pattern DT4 is transmitted to the control element, 0 is set by the latch 901*a*, and although the pulse P1 is not applied to the pressure generating element, the data 916 is set to 1 by the latch 902, the data 917 is set to 1 by the latch 903, the data 918 is set to 1 by the latch 904, and the data 919 is set to 1 by the latch 905. The drive waveform is turned on at the timing of the latch 902 to apply the pulses P2 to P5 to the pressure generating element, thereby ejecting a large liquid drop. When any very large liquid drop is not ejected in the next printing cycle, 0 is set by the latch 901*b*, thereby turning off the drive waveform at the timing of the latch 901*b*.

When data having the data pattern DT5 is transmitted to the control element, the data 920 is set to 1 by the latch 901*a*, the data 921 is set to 1 by the latch 902, the data 922 is set to 1 by the latch 903, the data 923 is set to 1 by the latch 904, and the data 924 is set to 1 by the latch 905. The drive waveform is turned on at the timing of the latch 901*a* to apply the pulses P1 to P5 to the pressure generating element, thereby ejecting a very large liquid drop. When any very large liquid drop is not ejected in the next printing cycle, 0 is set by the latch 901*b*, thereby turning off the drive waveform at the timing of the latch 901*b*.

When a very large liquid drop is ejected in the next printing cycle, data that becomes HIGH between the latches 905 and 901*b* is provided, and set to 1 by the latch 901*b*. Therefore, the drive waveform is not turned off at the timing of the latch 901*b* and is continuously applied to the pressure generating element.

The timing to turn off the drive waveform is after a moment when the current of the drive waveform decreases to a level at which noise of a size that causes a problem is not generated even if the drive waveform is turned off. In the inkjet head according to the present invention, it is after 1.5 microseconds or more after the voltage of the pulse becomes substantially constant. However, this value varies according to the type of the pressure generating element, the constant, the number of driving nozzles, the drive waveform, the circuit or the like.

It is further desirable if the timing to turn off the drive waveform can be set after a moment when the current flowing to the pressure generating element decreases to a level at which noise is not generated even when the drive waveform is turned off, after the voltage of the pulse becomes substantially constant. In the inkjet head according to the sixth embodiment, the time is after 2.2 microseconds or more after the voltage of the pulse becomes substantially constant.

The timing to turn on the drive waveform is before the voltage of each pulse starts to change by more than the reaction time of the control element. In the inkjet head used for experiments this time, it is 0.3 microsecond or more before the voltage of each pulse starts to change. This value varies according to the control element, the circuit or the like.

It can be set for each nozzle and for each printing cycle which the data pattern from DT0 to DT5 is to be transmitted to the control element. The control element performs ON/OFF control of the drive waveform for each nozzle and for each printing cycle according to the set data, to eject liquid drops of different sizes, thereby enabling to perform gray scale recording.

In the sixth embodiment, the latch signal as explained with reference to FIG. 10 and therefore a latch signal generator, and the control element serve as a setting unit that sets the timing to turn off the drive waveform to be concentrated on a specific position of the drive waveform of the plurality of pulses where a long time with substantially no voltage fluctuation can be ensured. Further, the data signal of the pattern as explained with reference to FIG. 10 and therefore a data signal generator, and the control element serve also as a selecting unit that sequentially selects a pulse present before the specific position timewise starting from the specific position.

Figure 11:
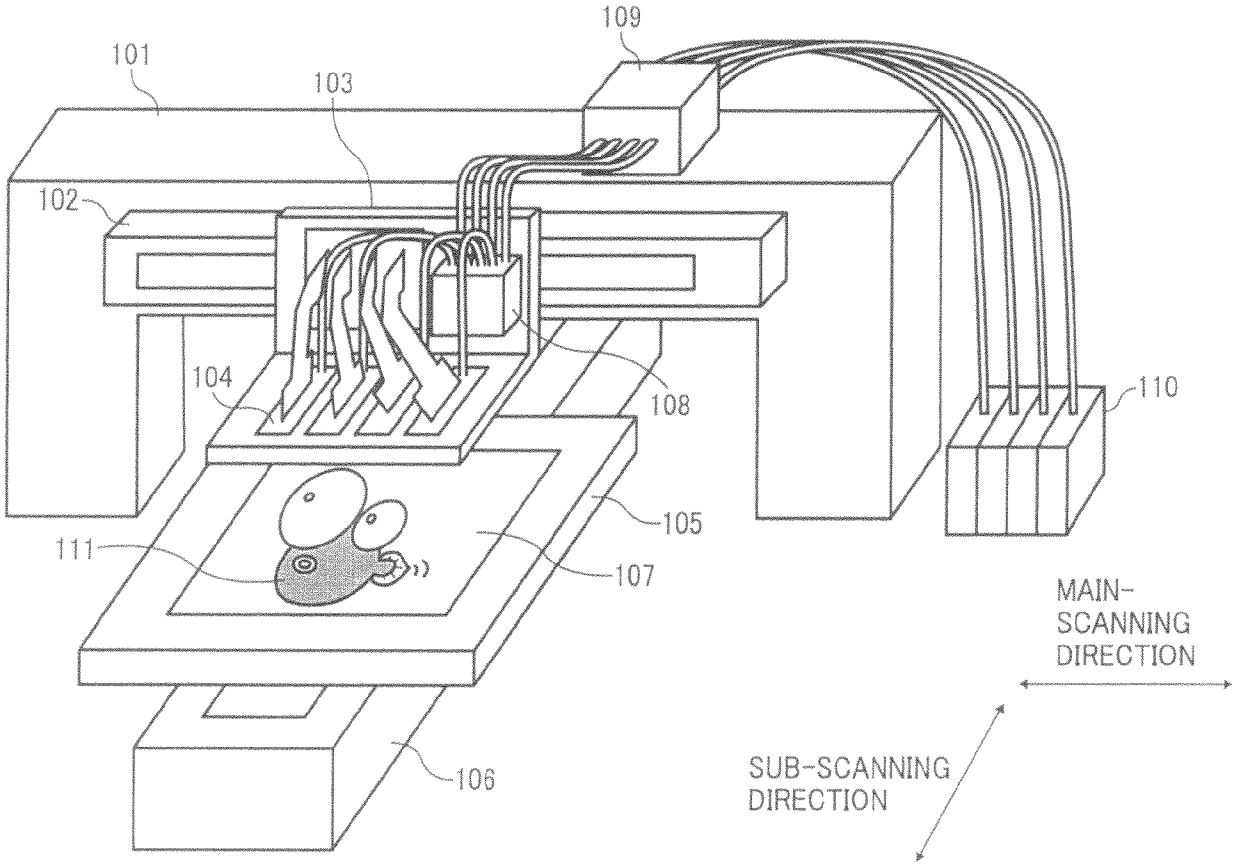
FIG. 11 is a perspective view of an image forming apparatus including a drive unit of an inkjet head according to the present invention.

FIG. 11 is an example of an image forming apparatus including a drive unit of the inkjet head according to the present invention.

An X-axis linear-motion guide 102 is provided on a gantry arm 101, and four inkjet heads 104 are fitted to a head base 103 fitted to the X-axis linear-motion guide 102, so that the inkjet heads 104 is movable in a main scanning direction. A stage 105 is fitted to a Y-axis linear-motion guide 106, and a recording medium 107 located on the stage 105 is movable in a sub-scanning direction perpendicular to the main scanning direction.

The inkjet heads 104 are supplied with ink from a sub ink tank 108, and the sub ink tank 108 is decompressed to an appropriate pressure at all times by a negative-pressure controller/ink-replenishing pump 109, so that the ink does not drip off from a nozzle. When a remaining amount of the ink in the sub ink tank 108 decreases, the ink is replenished from a main ink tank 110 by the negative-pressure controller/ink-replenishing pump 109.

A control element (not shown) is mounted on the inkjet head 104, and the drive waveform and an ON/OFF control signal as shown in FIG. 8, a data signal, a clock signal, and a latch signal are transmitted from a high-order controller (not shown) to the control element.

Data is read for each nozzle by the data signal and the clock signal, and it is selected by which an ON/OFF control signal to turn on/off the drive waveform with respect to which nozzle. The drive waveform is then applied to the pressure generating element of each nozzle, so that 4 gray scale recording by no ejection and liquid drops of large, medium, and small sizes can be performed.

A part of a desired image is formed on the recording medium 107 by performing 4 gray scale recording according to whether to eject the ink of three sizes from the inkjet heads 104 toward the recording medium 107, while moving the inkjet heads 104 by the X-axis linear-motion guide 102. Further, a part of the desired image is formed on the recording medium 107 by performing 4 gray scale recording according to whether to eject the ink of three sizes of large, medium, and small, from the inkjet heads 104 toward the recording medium 107, while moving the inkjet heads 104 in the main scanning direction again by the X-axis linear-motion guide 102, after the recording medium 107 is moved in the sub-scanning direction by a desired amount by the Y-axis linear-motion guide 106. By repeating this operation, a desired image 111 is formed on the recording medium 107.

The four inkjet heads are supplied with ink of cyan, magenta, yellow, and black, respectively, to perform 4 gray scale recording, and one pixel is formed by overlapping respective colors. Therefore, a color image can be formed with 256 (=4×4×4×4) gray scales per one pixel.

The drive unit of the inkjet head according to the present invention can be applied to an overall configuration of the image forming apparatus using a known inkjet head, and is not limited to the configuration shown in FIG. 11.

There has been explained an example in which a pressure generating element is a piezoelectric element as a capacitive load, and even if a voltage of a drive waveform becomes constant, a charging and discharging current continues to flow for a while. When the pressure generating element is the capacitive load (a pressure generating element having capacitor characteristics), a time difference since the voltage of the drive waveform becomes constant until the current of the drive waveform does not flow is large. Therefore, the present invention is preferable when the pressure generating element is a capacitive load. However, the present invention is also applicable to an inkjet head in which a current flows to a path of a drive waveform for a while even when a voltage of the drive waveform becomes constant. The pressure generating element is not limited to a piezoelectric element, and a head structure is not limited to the structure explained with reference to FIG. 1.

Further, a case of performing 6 gray scale recording and a case of performing 4 gray scale recording have been explained above. However, the present invention is also applicable in a case of 3 gray scales or more except for the appended claim 3, and also applicable in a case of 4 gray scales or more in the appended claim 3.

Further, the control system described in the present specification is a general example, and can be applied also to an inkjet head using a control system in which the ON/OFF control signal is individually transmitted to a switch provided for each nozzle to control the drive. The present invention is not limited by the control system such as the signal type, or a difference between HIGH active and LOW active or the like.

So long as voltage fluctuation of the drive waveform is such that the current of the drive waveform decreases up to a level at which large noise that causes a problem is not generated in the drive waveform even if the drive waveform is turned off, even when the voltage of the drive waveform slightly varies, the specific position and the second specific position in the claims of the present invention can be set.

Further, the number of the timing to turn off the drive waveform to be concentrated on the specific position in the claims is more than the number of other positions at which an off timing is set.

According to one aspect of the present invention, a liquid-drop ejection-head drive head and a liquid-drop ejection-head driving method that can eject liquid drops of different sizes without generating large noise that causes a problem, even if an interval between pulses is narrow can be provided.

Furthermore, according to another aspect of the present invention, a liquid-drop ejection-head drive head and a liquid-drop ejection-head driving method can be provided, in which a landing position of a relatively small liquid drop is not largely deviated from a landing position of a relatively large liquid drop.

Moreover, according to still another aspect of the present invention, a liquid-drop ejection-head drive head and a liquid-drop ejection-head driving method that can reduce costs can be provided, because a liquid drop of the largest size can be ejected with a limited voltage applicable to a pressure generating element, and a drive-waveform forming unit can be formed with a simple circuit.

Furthermore, according to still another aspect of the present invention, a liquid-drop ejection-head drive head and a liquid-drop ejection-head driving method having a large noise reduction effect can be provided with respect to a driving method that ejects liquid drops of different sizes by using a drive waveform with a narrow interval between pulses.

Moreover, according to still another aspect of the present invention, an image forming apparatus capable of performing high-speed operations and producing high gradation images can be provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A device for driving a liquid-drop ejection head that includes a plurality of nozzles each ejecting liquid, a pressure generating element that generates pressure for ejecting the liquid, provided for each of the nozzles, and a drive-waveform control unit that determines whether to apply a drive waveform having a plurality of pulses in one printing cycle to the pressure generating element and controls a timing to apply the drive waveform to the pressure generating element, the device selecting a desired pulse from the drive waveform, applying a selected pulse to the pressure generating element, and ejecting liquid drops of different sizes from a same nozzle for each printing cycle based on the selected pulse, the device comprising:

a setting unit configured to set timings for the drive-waveform control unit to turn off the drive waveform such that at least two of the timings are concentrated in one position of the drive waveform, the one position being a position where a state in which a voltage of the drive waveform shows substantially no fluctuation is maintained for more than a moment during which a current of the drive waveform decreases to a level at which a noise that is large enough to cause a problem is not generated even when the drive waveform is turned off; and a selecting unit configured to sequentially select pulses present before the one position in time from the one position, wherein the device applies a pulse selected by the selecting unit to the pressure generating element.

2. The device according to claim 1, wherein when there is an additional position where the state in which a voltage of the drive waveform shows substantially no fluctuation is maintained for more than a moment during which a current of the drive waveform decreases to a level at which a noise that is larger enough to cause a problem is not generated even upon the drive waveform present before the one position in time is turned off, the setting unit sets a timing for the drive-waveform control unit to turn off the drive waveform to the additional position at a time of selecting a pulse for ejecting a small liquid drop.

3. The device according to claim 1, wherein the pulses in the drive waveform have a voltage waveform of a same shape, and the device ejects the liquid drops of different sizes from the same nozzle for each printing cycle by changing a number of pulses to be applied to the pressure generating element.

4. The device according to claim 1, wherein voltages of the pulses gradually increase, the device ejects the liquid drops of different sizes from the same nozzle according to a difference in the voltages of the pulses to be applied to the pressure generating element, and the one position is set between a pulse having a highest voltage from among the pulses and a leading pulse of a next printing cycle.

5. The device according to claim 1, wherein the pulses include a first pulse having a first voltage, and a second pulse having a second voltage higher than the first voltage, the second pulse being present immediately after the first pulse, and the one position is set between the first pulse and the second pulse.

6. The device according to claim 1, wherein the pulses include a no-ejection pulse to be applied to the pressure generating element when a liquid is not ejected from the nozzle, and the no-ejection pulse is applied to the pressure generating element to charge the pressure generating element.

7. The device according to claim 1, wherein the pressure generating element has a characteristic of a capacitor.

8. The device according to claim 1, wherein a number of the at least two of the timings to turn off the drive waveform set to the one position is larger than a number of one or more of the timings to turn off the drive waveform that are set to any other position.

9. A method of driving a liquid-drop ejection head that includes a plurality of nozzles each ejecting liquid, a pressure generating element that generates pressure for ejecting the liquid, provided for each of the nozzles, and a drive-waveform control unit that determines whether to apply a drive waveform having a plurality of pulses in one printing cycle to the pressure generating element and controls a timing to apply the drive waveform to the pressure generating element, selecting a desired pulse from the drive waveform, applying a selected pulse to the pressure generating element, and ejecting liquid drops of different sizes from a same nozzle for each printing cycle based on the selected pulse, the method comprising:

setting timings for the drive-waveform control unit to turn off the drive waveform such that at least two of the timings are concentrated in one position of the drive waveform, the one position being a position where a state in which a voltage of the drive waveform shows substantially no fluctuation is maintained for more than a moment during which a current of the drive waveform decreases to a level at which a noise that is large enough to cause a problem is not generated even when the drive waveform is turned off;

selecting sequentially pulses present before the one position in time from the one position; and applying a pulse selected by the selecting unit to the pressure generating element.

10. The method according to claim 9, wherein when there is an additional position where the state in which a voltage of the drive waveform shows substantially no fluctuation is maintained for more than a moment during which a current of the drive waveform decreases to a level at which a noise that is larger enough to cause a problem is not generated even when the drive waveform present before the one position in time is turned off, the setting includes setting a timing for the drive-waveform control unit to turn off the drive waveform to the additional position at a time of selecting a pulse for ejecting a small liquid drop.

11. The method according to claim 9, wherein the pulses in the drive waveform have a voltage waveform of a same shape, and the method further comprises ejecting liquid drops of different sizes from a same nozzle for each printing cycle by changing a number of pulses to be applied to the pressure generating element.

12. The method according to claim 9, wherein voltages of the pulses gradually increase, the method further comprises ejecting liquid drops of different sizes from a same nozzle according to a difference in the voltages of the pulses to be applied to the pressure generating element, and the one position is set between a pulse having a highest voltage from among the pulses and a leading pulse of a next printing cycle.

13. The method according to claim 9, wherein the pulses include a first pulse having a first voltage, and a second pulse having a second voltage higher than the first voltage, the second pulse being present immediately after the first pulse, and the one position is set between the first pulse and the second pulse.

14. The method according to claim 9, wherein the pulses include a no-ejection pulse to be applied to the pressure generating element when a liquid is not ejected from the nozzle, and the no-ejection pulse is applied to the pressure generating element to charge the pressure generating element.

15. The method according to claim 9, wherein the pressure generating element has a characteristic of a capacitor.

16. The method according to claim 9, wherein a number of the at least two of the timings to turn off the drive waveform set to the one position is larger than a number of one or more of the timings to turn off the drive waveform that are set to any other position.

17. An image forming apparatus, comprising:

a device configured to drive a liquid-drop ejection head that includes a plurality of nozzles each configured to eject liquid, a pressure generating element configured to generate a pressure for ejecting the liquid, provided for each of the nozzles, and a drive-waveform control unit configured to determine whether to apply a drive waveform having a plurality of pulses in one printing cycle to the pressure generating element and controls a timing to apply the drive waveform to the pressure generating element, the device selecting a desired pulse from the drive waveform, applying a selected pulse to the pressure generating element, and ejecting liquid drops of different sizes from a same nozzle for each printing cycle based on the selected pulse, wherein the device further includes:

a setting unit configured to set timings for the drive-waveform control unit to turn off the drive waveform such that at least two of the timings are concentrated in one position of the drive waveform, the one position being a position where a state in which a voltage of the drive waveform shows substantially no fluctuation is maintained for more than a moment during which a current of the drive waveform decreases to a level at which a noise that is large enough to cause a problem is not generated even when the drive waveform is turned off, and a selecting unit configured to sequentially select pulses present before the one position in time from the one position, the device configured to apply a pulse selected by the selecting unit to the pressure generating element, and the liquid to be ejected is ink.

18. The image forming apparatus according to claim 17, wherein a plurality of liquid-drop ejection heads of a same type as the liquid-drop ejection head are provided, and inks of different colors are supplied to the liquid-drop ejection heads.

19. A device for driving a liquid-drop ejection head that includes a plurality of nozzles each ejecting liquid, a pressure generating element that generates pressure for ejecting the liquid, provided for each of the nozzles, and a drive-waveform control unit that determines whether to apply a drive waveform having a plurality of pulses in one printing cycle to the pressure generating element and controls a timing to apply the drive waveform to the pressure generating element, the device selecting a desired pulse from the drive waveform, applying a selected pulse to the pressure generating element, and ejecting liquid drops of different sizes from a same nozzle for each printing cycle based on the selected pulse, the device comprising:

a setting unit configured to set timings for the drive-waveform control unit to turn off the drive waveform such that at least two of the timings are concentrated in one position of the drive waveform where a relatively long period of time with substantially no voltage fluctuation can be ensured; and a selecting unit configured to sequentially select pulses present before the one position in time from the one position, wherein when there is an additional position where the state in which a voltage of the drive waveform shows substantially no fluctuation is maintained for more than a moment during which a current of the drive waveform decreases to a level at which a noise that is larger enough to cause a problem is not generated even upon the drive waveform present before the one position in time is turned off, the setting unit sets a timing for the drive-waveform control unit to turn off the drive waveform at the additional position at a time of selecting a pulse for ejecting a small liquid drop, and the device applies the pulse selected by the selecting unit to the pressure generating element.

20. A method of driving a liquid-drop ejection head that includes a plurality of nozzles each ejecting liquid, a pressure generating element that generates pressure for ejecting the liquid, provided for each of the nozzles, and a drive-waveform control unit that determines whether to apply a drive waveform having a plurality of pulses in one printing cycle to the pressure generating element and controls a timing to apply the drive waveform to the pressure generating element, selecting a desired pulse from the drive waveform, applying a selected pulse to the pressure generating element, and ejecting liquid drops of different sizes from a same nozzle for each printing cycle based on the selected pulse, the method comprising:

setting timings for the drive-waveform control unit to turn off the drive waveform such that at least two of the timings are concentrated at one position of the drive waveform where a relatively long period of time with substantially no voltage fluctuation can be ensured;

selecting sequentially pulses present before the one position in time from the one position; and applying a pulse selected by the selecting unit to the pressure generating element, wherein wherein when there is an additional position where the state in which a voltage of the drive waveform shows substantially no fluctuation is maintained for more than a moment during which a current of the drive waveform decreases to a level at which a noise that is larger enough to cause a problem is not generated even when the drive waveform present before the one position in time is turned off, the setting includes setting a timing for the drive-waveform control unit to turn off the drive waveform to the additional position at a time of selecting a pulse for ejecting a small liquid drop.

21. An image forming apparatus, comprising:

a device configured to drive a liquid-drop ejection head that includes a plurality of nozzles each configured to eject liquid, a pressure generating element configured to generate a pressure for ejecting the liquid, provided for each of the nozzles, and a drive-waveform control unit configured to determine whether to apply a drive waveform having a plurality of pulses in one printing cycle to the pressure generating element and controls a timing to apply the drive waveform to the pressure generating element, the device selecting a desired pulse from the drive waveform, applying a selected pulse to the pressure generating element, and ejecting liquid drops of different sizes from a same nozzle for each printing cycle based on the selected pulse, wherein the device further includes:

a setting unit configured to set timings for the drive-waveform control unit to turn off the drive waveform such that at least two of the timings are concentrated in one position of the drive waveform where a relatively long period of time with substantially no voltage fluctuation can be ensured, and a selecting unit configured to sequentially select pulses present before the one position in time from the one position, the device configured to apply a pulse selected by the selecting unit to the pressure generating element, and the liquid to be ejected is ink, wherein when there is an additional position where the state in which a voltage of the drive waveform shows substantially no fluctuation is maintained for more than a moment during which a current of the drive waveform decreases to a level at which a noise that is larger enough to cause a problem is not generated even upon the drive waveform present before the one position in time is turned off, the setting unit sets a timing for the drive-waveform control unit to turn off the drive waveform at the additional position at a time of selecting a pulse for ejecting a small liquid drop.

* * * * *